US012121169B1

(12) United States Patent
Biedel

(10) Patent No.: US 12,121,169 B1
(45) Date of Patent: Oct. 22, 2024

(54) DRINKING CUP AND MODIFIED STRAW ASSEMBLY

(71) Applicant: Brent Biedel, Phoenix, AZ (US)

(72) Inventor: Brent Biedel, Phoenix, AZ (US)

( * ) Notice: Subject to any disclaimer, the term of this patent is extended or adjusted under 35 U.S.C. 154(b) by 17 days.

(21) Appl. No.: 18/133,142

(22) Filed: Apr. 11, 2023

(51) Int. Cl.
*A47G 19/22* (2006.01)

(52) U.S. Cl.
CPC ..... *A47G 19/2272* (2013.01)

(58) Field of Classification Search
CPC ..... A47G 19/2266
See application file for complete search history.

(56) References Cited

U.S. PATENT DOCUMENTS 2,194,011 A 3/1940 Davidson
5,005,717 A 4/1991 Oilar
5,385,264 A * 1/1995 Kaufman ..... B65D 77/286 215/388
5,560,513 A * 10/1996 Jarrell ..... A47G 19/2266 220/709
6,082,583 A * 7/2000 Bussell ..... A61J 9/00 224/407
D516,864 S 3/2006 Kleckauskas
7,185,782 B2 3/2007 Vilchez
8,851,324 B2 10/2014 O'Sullivan
9,242,588 B1 1/2016 Martini
10,420,433 B2 9/2019 Coon
D873,603 S * 1/2020 Diener ..... D7/392.1
10,703,544 B2 * 7/2020 Spivey ..... A47G 19/2266
2003/0085232 A1 5/2003 Leinenweber
2004/0060888 A1 * 4/2004 Ahn ..... F16K 15/08 215/11.1
2005/0077304 A1 * 4/2005 Connelly ..... A47G 19/2266 220/709
2014/0050816 A1 * 2/2014 Campbell ..... A47G 21/185 426/2
2015/0148843 A1 * 5/2015 Turley ..... A61J 17/001 606/234
2015/0335186 A1 * 11/2015 MacDonald ..... A47G 21/18 239/13
2016/0213573 A1 * 7/2016 Rosskamm ..... A61J 9/04
2017/0311742 A1 * 11/2017 Leslein ..... A47G 19/2205
2018/0099805 A1 * 4/2018 Johnson ..... B65D 81/3205
2019/0387907 A1 * 12/2019 Capone ..... B65D 43/0231
2020/0060458 A1 * 2/2020 Neyhart ..... A47G 23/0225
2020/0337482 A1 * 10/2020 Colby ..... A47G 19/2272
2021/0282585 A1 * 9/2021 Lee ..... A47J 31/20
(Continued)

FOREIGN PATENT DOCUMENTS

GB 2465363 11/2008

*Primary Examiner* — Don M Anderson

(57) ABSTRACT

A drinking cup and modified straw assembly for facilitating drinking in a supine position includes a cup enclosing an interior space containing a fluid. The cup includes a base wall and a perimeter wall. A lid is mounted to the top edge of the cup and has a hole extending through there. A drinking straw is elongated from a first end to a second end and has an upper bend to define a first section and a second section. The first section extends through the hole such that the first end is positioned adjacent to the base wall. The drinking straw has a lower bend to define a third section. The lower bend forms an acute angle between the second and third sections such that the third section is angled upwardly away from a plane of the base wall.

8 Claims, 4 Drawing Sheets

(56) References Cited

U.S. PATENT DOCUMENTS

| | | | | |
|---|---|---|---|---|
| 2021/0307547 | A1* | 10/2021 | Perkins | A47G 21/18 |
| 2022/0218132 | A1* | 7/2022 | Bullock | A47G 19/2272 |
| 2022/0386796 | A1* | 12/2022 | Hsieh | A47G 19/2222 |

* cited by examiner

DRINKING CUP AND MODIFIED STRAW ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) FIELD OF THE INVENTION

The disclosure relates to drinking cups and more particularly pertains to a new drinking cup for facilitating drinking from a container while lying in a supine position.

(2) DESCRIPTION OF RELATED ART INCLUDING INFORMATION DISCLOSED UNDER 37 CFR 1.97 AND 1.98

The prior art relates to drinking cups and includes a variety of drinking cups having a drinking straw. Known prior art does not include a modified drinking straw being mounted to a lid of the drinking cup and including a bend therein to allow a user to be able to drink from the drinking cup while in a supine position.

(h) BRIEF SUMMARY OF THE INVENTION

An embodiment of the disclosure meets the needs presented above by generally comprising a cup enclosing an interior space containing a fluid. The cup includes a base wall and a perimeter wall coupled to and extending upwardly from the base wall. A top edge of the perimeter wall defines an opening into the interior space. A lid is removably mounted to the top edge of the cup and has a hole extending therethrough. A drinking straw is elongated and has a first end being open and defining an inlet and a second end being open and defining an outlet. The drinking straw has an upper bend therein to define a first section and a second section positioned adjacent to each other and being orientated parallel to each other. The first section includes the first end and the first section extends through the hole such that the first end is positioned adjacent to the base wall.

The drinking straw has a lower bend therein to define a third section including the second end. The lower bend is positioned within 2.0 inches of a plane of the base wall and the lower bend forms an acute angle between the second and third sections such that the third section is angled upwardly away from the plane of the base wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
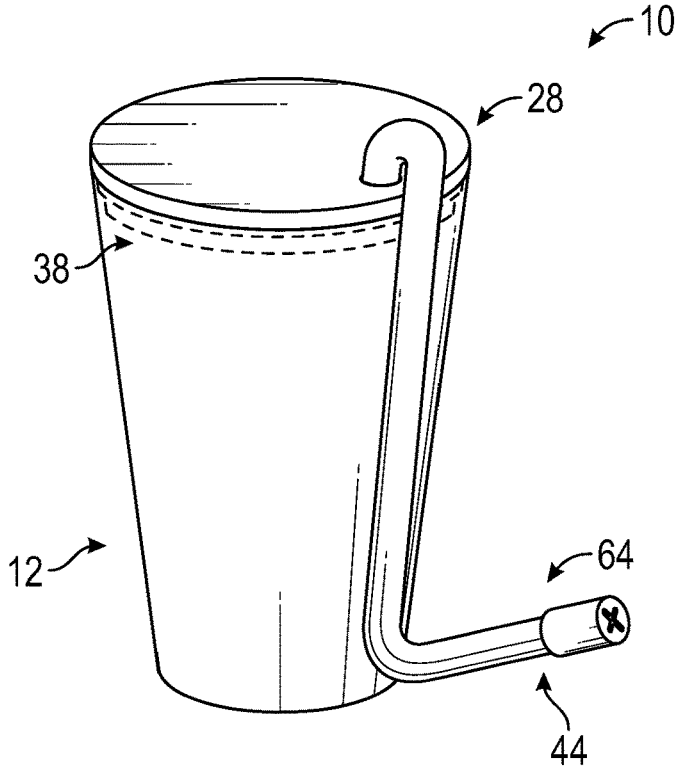
FIG. 1 is a top isometric view of a drinking cup and modified straw assembly according to an embodiment of the disclosure.
Figure 2:
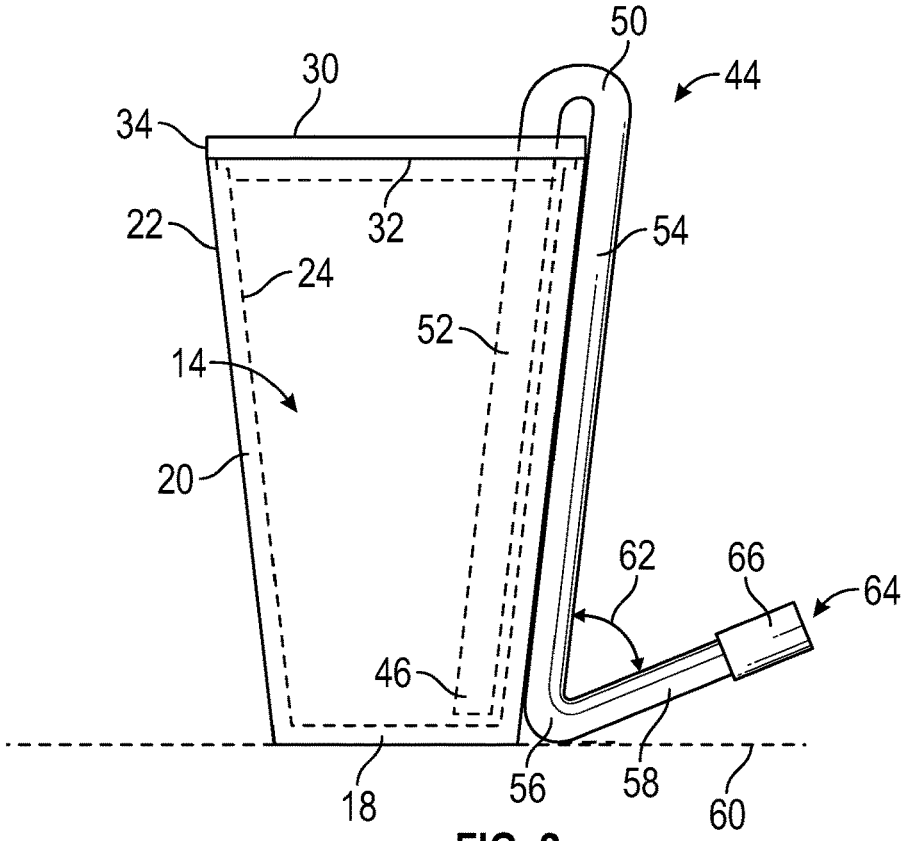
FIG. 2 is a side view of an embodiment of the disclosure.
Figure 3:
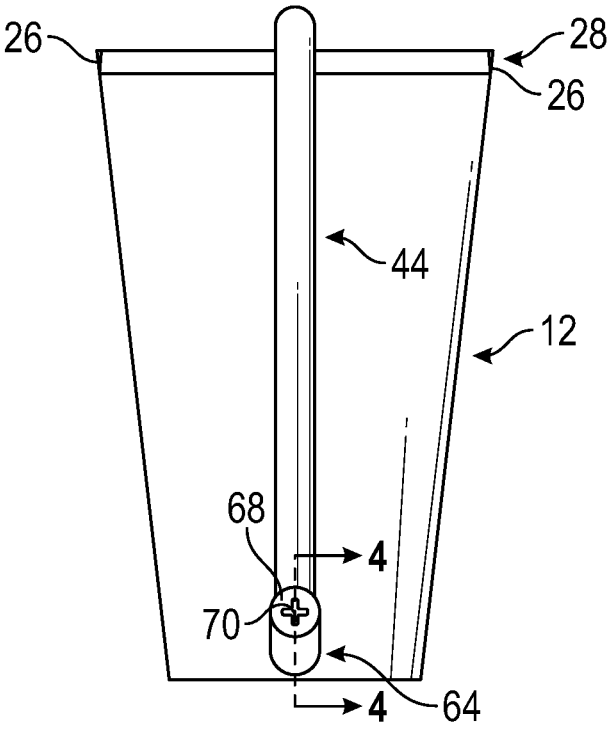
FIG. 3 is a front view of an embodiment of the disclosure.
Figure 4:
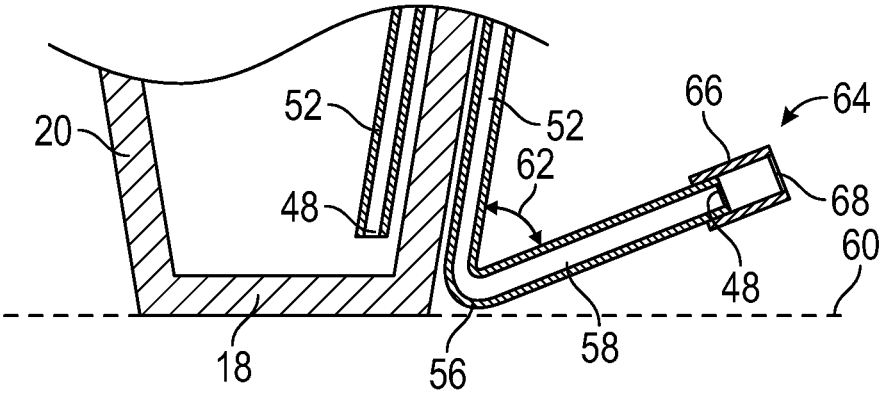
FIG. 4 is a cross-sectional view of an embodiment of the disclosure taken along Line 4-4 of FIG. 3.
Figure 5:
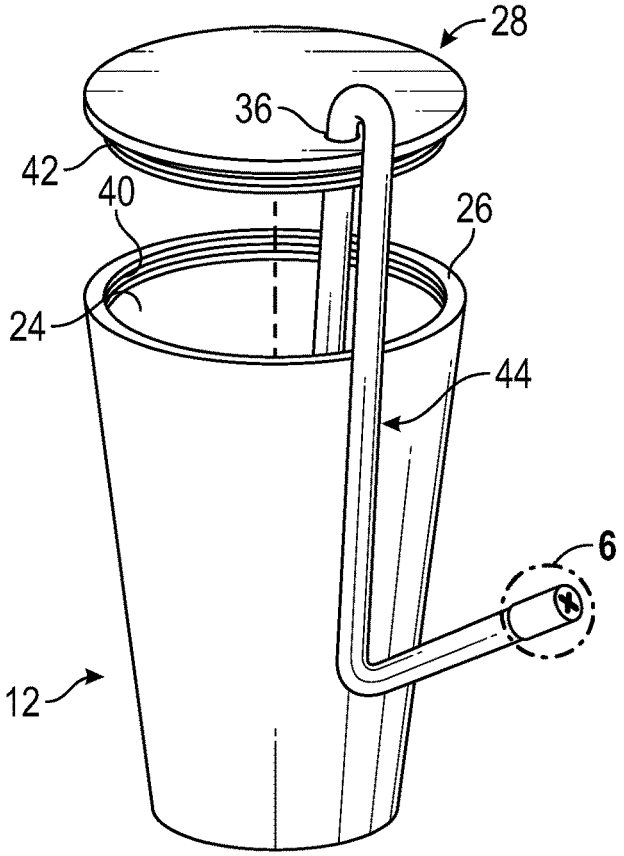
FIG. 5 is an exploded view of an embodiment of the disclosure.
Figure 6:
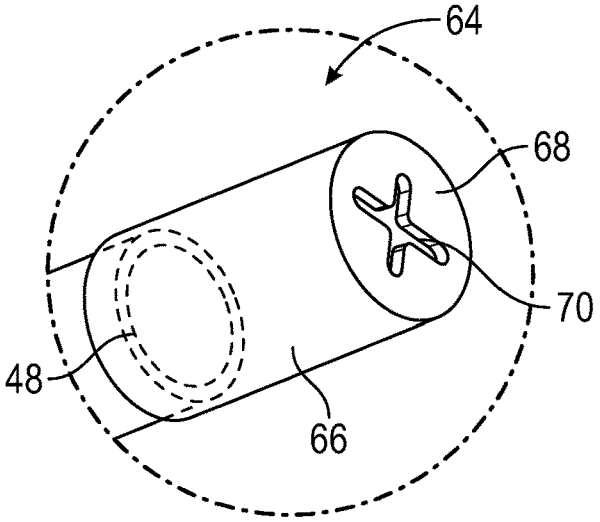
FIG. 6 is a detailed view of an embodiment of the disclosure.
Figure 7:
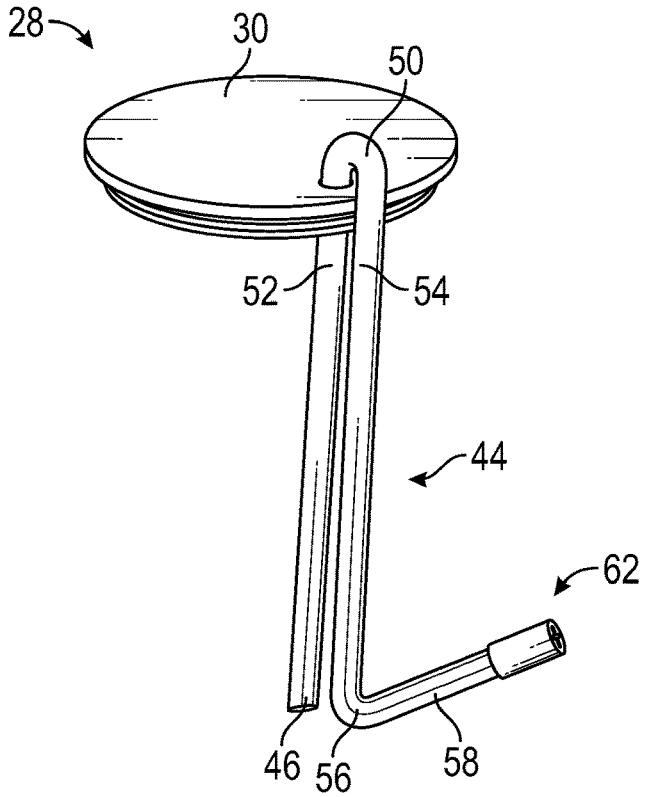
FIG. 7 is a detailed view of an embodiment of the disclosure.
Figure 8:
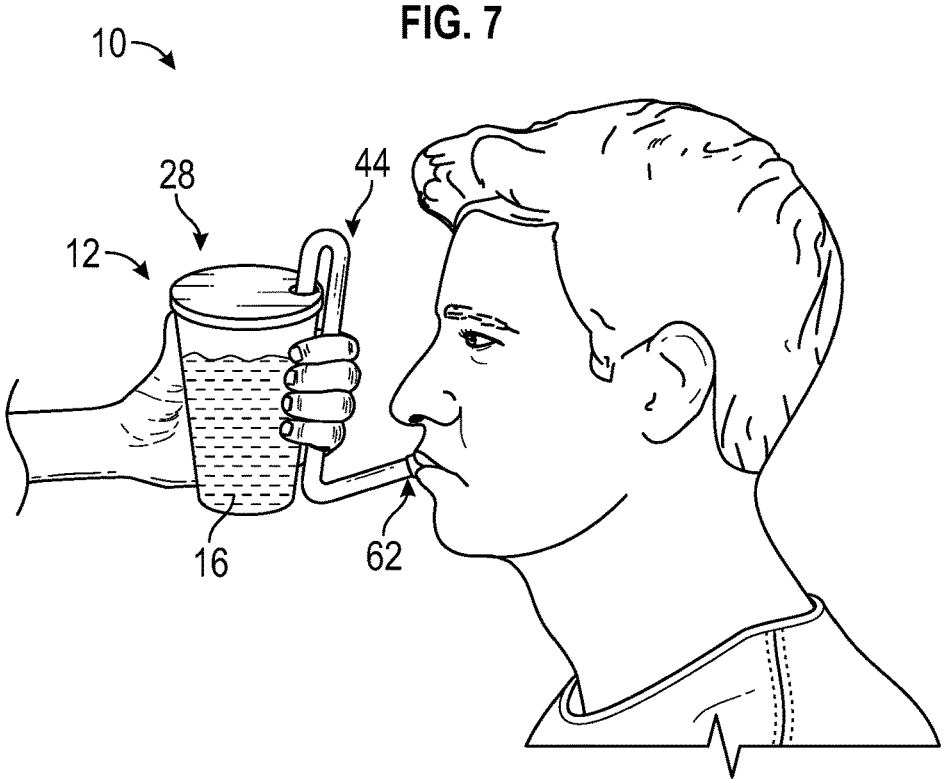
FIG. 8 is an in-use view of an embodiment of the disclosure.

With reference now to the drawings, and in particular to FIGS. 1 through 8 thereof, a new drinking cup embodying the principles and concepts of an embodiment of the disclosure and generally designated by the reference numeral 10 will be described.

As best illustrated in FIGS. 1 through 8, the drinking cup and modified straw assembly 10 generally comprises a cup 12 enclosing an interior space 14 containing a fluid 16. The cup 12 includes a base wall 18 and a perimeter wall 20 coupled to and extending upwardly from the base wall 18. The perimeter wall 20 has an exterior surface 22 and an interior surface 24. A top edge 26 of the perimeter wall 20 defines an opening into the interior space 14. The base wall 18 is typically a circular shape, and the perimeter wall 20 normally tapers from the top edge 26 of the perimeter wall 20 to the base wall 18.

A lid 28 is removably mounted to the top edge 26 of the cup 12. The lid 28 normally comprises a disc having a top surface 30, a bottom surface 32, and a boundary edge 34. The lid 28 removably encloses the interior space 14 of the cup 12, wherein the bottom surface 32 of the lid 28 abuts the top edge 26 of the perimeter wall 20 when the lid 28 is mounted to the cup 12 and the boundary edge 34 is flush to the exterior surface 22 of the perimeter wall 20. The lid 28 has a hole 36 extending therethrough. The hole 36 typically extends through the top surface 30 and the bottom surface 32 of the lid 28.

A seal 38 retains the lid 28 in engagement with the cup 12. The seal 38 typically includes a first mating member 40 being mounted to the cup 12 and normally comprises threading formed on the interior surface 24 adjacent to the top edge 26 of the perimeter wall 20. A second mating member 42 is mounted to the lid 28 and removably couples with the first mating member 40, wherein the lid 28 removably couples to the cup 12. The second mating member 42 normally comprises a flange extending from the bottom surface 32 of the lid 28 and an outer surface of the flange has threading formed thereon.

A drinking straw 44 is elongated and has a first end 46 being open and defining an inlet and a second end 48 being open and defining an outlet. The drinking straw 44 has an upper bend 50 therein to define a first section 52 and a second section 54 positioned adjacent to each other and being orientated parallel to each other. The first section 52 includes the first end 46 and the first section 52 extends through the hole 36 such that the first end 46 is positioned adjacent to the base wall 18. The drinking straw 44 has a lower bend 56 therein to define a third section 58 including the second end 48. The lower bend 56 is typically positioned within 2.0 inches of a plane 60 of the base wall 18. More typically, the lower bend 56 will be positioned equal with or above the plane 60 of the base wall 18. The lower bend 56 forms an acute angle 62 between the second 54 and third 58 sections such that the third section 58 is angled upwardly away from the plane 60 of the base wall 18. The acute angle 62 is typically between 60 angular degrees and 80 angular degrees, wherein the third section 58 is angled between 10 angular degrees and angular degrees between the plane 60 of the base wall 18. The drinking straw 44 typically comprises a rigid material such as plastic, metal, or any other conventionally rigid material such that the drinking straw 44 resiliently retains its form.

A mouthpiece 64 is coupled to and covers the second end 48 of the drinking straw 44. The mouthpiece 64 comprises a sleeve 66 receiving the second end 48. An end wall 68 covering is attached to the sleeve 66 and covers the second end 48 of the drinking straw 44. The end wall 68 comprises a resealable valve 70 allowing fluid 16 to flow outwardly of the drinking straw 44 through the second end 48 when negative pressure is applied to an exterior of the mouthpiece 64. The mouthpiece 64 normally comprises a resiliently bendable material such as rubber, wherein the resealable valve 70 is able to form into a closure when suction is not applied to the mouthpiece 64.

In use, the user is able to drink from the cup 12 when in a supine position by sucking on the mouthpiece 64 of the drinking straw 44. The drinking straw 44 pulls the fluid 16 from the interior space 14 of the cup 12 when suction is applied by the user to the mouthpiece 64. The releasable valve of the mouthpiece 64 forms into a closure when suction is not applied to retain the fluid 16 within the drinking straw 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drinking cup assembly configured for facilitating drinking from a cup while a user is in a supine position, said drinking cup assembly comprising:

a cup enclosing an interior space containing a fluid, said cup including a base wall and a perimeter wall coupled to and extending upwardly from said base wall, a top edge of said perimeter wall defining an opening into said interior space;

a lid being removably mounted to said top edge of said cup, said lid having a hole extending therethrough; and a drinking straw being elongated and having a first end being open and defining an inlet and a second end being open and defining an outlet, said drinking straw having an upper bend therein to define a first section and a second section positioned adjacent to each other and being orientated parallel to each other, said first section including said first end, said first section extending through said hole such that said first end is positioned adjacent to said base wall, said drinking straw having a lower bend therein to define a third section including said second end, said lower bend being positioned within 2.0 inches of a plane of said base wall, said lower bend forming an acute angle between said second and third sections such that said third section is angled upwardly away from said plane of the base wall, said second end being positioned closer to said plane of said base wall than to an upper plane which is parallel to said plane of said base wall and which extends through said top edge of said cup, said drinking straw is rigid and resiliently retains its form.

2. The drinking cup assembly of claim 1, wherein said base wall is a circular shape and said perimeter wall tapers from said top edge of said perimeter wall to said base wall.

3. The drinking cup assembly of claim 2, wherein said lid comprises a disc shape, said lid having a top surface, a bottom surface, and a boundary edge, said lid removably enclosing said interior space of said cup, wherein said bottom surface of said lid abuts said top edge of said perimeter wall when said lid is mounted to said cup and said boundary edge is flush to said exterior surface of said perimeter wall.

4. The drinking cup assembly of claim 3, wherein said hole extends through said top surface and said bottom surface of said lid.

5. The drinking cup assembly of claim 1, further including a seal retaining said lid in engagement with said cup.

6. The drinking cup assembly of claim 5, wherein said seal includes a first mating member being mounted to said cup, said first mating member comprising threading formed on said interior surface adjacent to said top edge of said perimeter wall, a second mating member being mounted to said lid and removably coupling with said first mating member, wherein said lid removably couples to said cup, said second mating member comprising a flange extending from said a bottom surface of said lid, an outer surface of said flange having threading formed thereon.

7. The drinking cup assembly of claim 1, wherein a mouthpiece being coupled to and covering said second end of said drinking straw, said mouthpiece comprising a sleeve receiving said second end, an end wall covering being attached to said sleeve and covering said second end of said drinking straw, said wall comprising a resealable valve, said resealable valve allowing fluid to flow outwardly of said drinking straw through said second end when negative pressure is applied to an exterior of said mouthpiece.

8. A drinking cup assembly configured for facilitating drinking from a cup while a user is in a supine position, said drinking cup assembly comprising:

a cup enclosing an interior space containing a fluid, said cup including a base wall and a perimeter wall coupled to and extending upwardly from said base wall, said perimeter wall having an exterior surface and an interior surface, a top edge of said perimeter wall defining an opening into said interior space, said base wall being a circular shape and said perimeter wall tapering from said top edge of said perimeter wall to said base wall;

a lid being removably mounted to said top edge of said cup, said lid comprising a disc shape, said lid having a top surface, a bottom surface, and a boundary edge, said lid removably enclosing said interior space of said cup, wherein said bottom surface of said lid abuts said top edge of said perimeter wall when said lid is mounted to said cup and said boundary edge is flush to said exterior surface of said perimeter wall, said lid having a hole extending therethrough, said hole extending through said top surface and said bottom surface of said lid;

a seal retaining said lid in engagement with said cup, said seal including:

a first mating member being mounted to said cup, said first mating member comprising threading formed on said interior surface adjacent to said top edge of said perimeter wall;

a second mating member being mounted to said lid and removably coupling with said first mating member, wherein said lid removably couples to said cup, said second mating member comprising a flange extending from said bottom surface of said lid, an outer surface of said flange having threading formed thereon;

a drinking straw being elongated and having a first end being open and defining an inlet and a second end being open and defining an outlet, said drinking straw having an upper bend therein to define a first section and a second section positioned adjacent to each other and being orientated parallel to each other, said first section including said first end, said first section extending through said hole such that said first end is positioned adjacent to said base wall, said drinking straw having a lower bend therein to define a third section including said second end, said lower bend being positioned within 2.0 inches of a plane of said base wall, said lower bend forming an acute angle between said second and third sections such that said third section is angled upwardly away from said plane of said base wall, said second end being positioned closer to said plane of said base wall than to an upper plane which is parallel to said plane of said base wall and which extends through said top edge of said cup; and a mouthpiece being coupled to and covering said second end of said drinking straw, said mouthpiece comprising a sleeve receiving said second end, an end wall covering being attached to said sleeve and covering said second end of said drinking straw, said wall comprising a resealable valve, said resealable valve allowing fluid to flow outwardly of said drinking straw through said second end when negative pressure is applied to an exterior of said mouthpiece drinking straw is rigid and resiliently retains its form.

* * * * *